US007698132B2

(12) United States Patent
Kandhadai et al.

(10) Patent No.: US 7,698,132 B2
(45) Date of Patent: Apr. 13, 2010

(54) SUB-SAMPLED EXCITATION WAVEFORM CODEBOOKS

(75) Inventors: Ananthapadamanabhan A. Kandhadai, San Diego, CA (US); Sharath Manjunath, San Diego, CA (US); Khaled El-Maleh, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 829 days.

(21) Appl. No.: 10/322,245

(22) Filed: Dec. 17, 2002

(65) Prior Publication Data

US 2004/0117176 A1 Jun. 17, 2004

(51) Int. Cl.
*G10L 19/00* (2006.01)
*G10L 19/12* (2006.01)
*G10L 21/02* (2006.01)

(52) U.S. Cl. ..... 704/222; 704/220; 704/223; 704/227; 704/230

(58) Field of Classification Search ..... 704/222–223, 704/220, 227, 230
See application file for complete search history.

(56) References Cited

U.S. PATENT DOCUMENTS 4,484,344 A * 11/1984 Mai et al. ..... 704/233
4,720,861 A * 1/1988 Bertrand ..... 704/222
4,890,328 A * 12/1989 Prezas et al. ..... 704/223
4,901,307 A 2/1990 Gilhousen et al.
5,103,459 A 4/1992 Gilhousen et al.
5,414,796 A 5/1995 Jacobs et al.
5,444,816 A * 8/1995 Adoul et al. ..... 704/219
5,459,814 A * 10/1995 Gupta et al. ..... 704/233
5,526,464 A * 6/1996 Mermelstein ..... 704/219
5,602,961 A * 2/1997 Kolesnik et al. ..... 704/223
5,617,145 A * 4/1997 Huang et al. ..... 348/423.1
5,701,392 A * 12/1997 Adoul et al. ..... 704/219
5,717,824 A * 2/1998 Chhatwal ..... 704/222
5,727,123 A * 3/1998 McDonough et al. ..... 704/224
5,754,235 A * 5/1998 Urano et al. ..... 375/240.03
5,754,976 A * 5/1998 Adoul et al. ..... 704/223
5,784,532 A * 7/1998 McDonough et al. ..... 704/224
5,799,110 A * 8/1998 Israelsen et al. ..... 382/253
5,890,110 A * 3/1999 Gersho et al. ..... 704/222
5,893,061 A * 4/1999 Gortz ..... 704/262
5,911,128 A * 6/1999 DeJaco ..... 704/200.1
5,924,062 A * 7/1999 Maung ..... 704/219

(Continued)

OTHER PUBLICATIONS

R. TUcker, "Voice activity detection using a periodicity measure", IEEE Proceedings, vol. 139, No. 4, Aug. 1992, pp. 377-380.*

(Continued)

*Primary Examiner*—Richemond Dorvil
*Assistant Examiner*—Eric Yen
(74) *Attorney, Agent, or Firm*—Kyong Macek; Michael J. DeHaemer

(57) ABSTRACT

Methods and apparatus are presented for reducing the number of bits needed to represent an excitation waveform. An acoustic signal in an analysis frame is analyzed to determine whether it is a band-limited signal. A sub-sampled sparse codebook is used to generate the excitation waveform if the acoustic signal is a band-limited signal. The sub-sampled sparse codebook is generated by decimating permissible pulse locations from the codebook track in accordance with the frequency characteristic of the acoustic signal.

36 Claims, 4 Drawing Sheets

U.S. PATENT DOCUMENTS

| | | | | |
|---|---|---|---|---|
| 5,926,786 | A * | 7/1999 | McDonough et al. | 704/224 |
| 5,970,444 | A * | 10/1999 | Hayashi et al. | 704/223 |
| 6,073,092 | A * | 6/2000 | Kwon | 704/219 |
| 6,148,283 | A * | 11/2000 | Das | 704/222 |
| 6,157,328 | A * | 12/2000 | Lu et al. | 341/67 |
| 6,169,971 | B1 * | 1/2001 | Bhattacharya | 704/225 |
| 6,173,257 | B1 * | 1/2001 | Gao | 704/220 |
| 6,199,040 | B1 * | 3/2001 | Fette et al. | 704/230 |
| 6,243,674 | B1 * | 6/2001 | Yu | 704/221 |
| 6,295,520 | B1 * | 9/2001 | Tian | 704/223 |
| 6,330,531 | B1 * | 12/2001 | Su | 704/204 |
| 6,493,665 | B1 * | 12/2002 | Su et al. | 704/230 |
| 6,507,814 | B1 * | 1/2003 | Gao | 704/220 |
| 6,539,349 | B1 * | 3/2003 | Benno | 704/219 |
| 6,556,966 | B1 * | 4/2003 | Gao | 704/220 |
| 6,574,213 | B1 * | 6/2003 | Anandakumar et al. | 370/349 |
| 6,714,907 | B2 * | 3/2004 | Gao | 704/220 |
| 6,782,367 | B2 * | 8/2004 | Vainio et al. | 704/500 |
| 6,823,303 | B1 * | 11/2004 | Su et al. | 704/220 |
| 6,968,092 | B1 * | 11/2005 | Winger | 382/253 |
| 6,983,242 | B1 * | 1/2006 | Thyssen | 704/208 |
| 7,039,581 | B1 * | 5/2006 | Stachurski et al. | 704/205 |
| 7,110,943 | B1 * | 9/2006 | Morii et al. | 704/223 |
| 7,177,804 | B2 * | 2/2007 | Wang et al. | 704/219 |
| 7,249,014 | B2 * | 7/2007 | Kannan et al. | 704/219 |
| 2001/0014856 | A1 * | 8/2001 | Wuppermann et al. | 704/223 |
| 2001/0018650 | A1 | 8/2001 | Dejaco | 704/200.1 |
| 2002/0095284 | A1 * | 7/2002 | Gao | 704/219 |
| 2002/0111798 | A1 | 8/2002 | Huang | |
| 2003/0046067 | A1 * | 3/2003 | Gradl | 704/217 |

OTHER PUBLICATIONS

E. Blackman, R. Viswanathan, J. Makhoul, "Variable-to-Fixed Rate Conversion of Narrowband LPC Speech", 1977.*

Milan Jelinek, Redwan Salami, Sassan Ahmadi, Bruno Bessette, Philippe Gournay, Claude Laflamme, Roch Lefebvre, "Advances in Source-Controlled Variable Bit Rate Wideband Speech Coding", 2004.*

M. H. Savoji, "A Robust Algorithm for Accurate Endpointing of Speech Signals", 1989, Speech Communications 8.*

Akamine M, et al. "Adaptive Density Pulse Excitation for Low Bit Rate Speech Coding" IEICE Transactions on Fundamentals of Electronics, Communications and Computer Sciences, Institute of Electronics Information and Comm. Eng. Tokyo, JP, vol. E78-A, No. 2, Feb. 1, 1995, pp. 199-207.

Delprat M. et al., "Fractional excitation and other efficient transformed codebooks for CELP coding of speech", Digital Signal Processing 2, Estimation, VLSI, San Francisco, Mar. 23-26, 1992, Proceeding of the International Conference on Acoustics, Speech and Signal Processing (ICASSP), New York, IEEE, US, vol. 5 Conf. 17, Mar. 23, 1992, pp. 329-332.

Zijun Yang et al., "High Performance CELP coder Utilizing a novel adaptive forward-backward LPC quantization" Multimedia Signal Processing, 1997, IEEE, US, Jun. 23, 1997, pp. 131-136.

S. Singhal and B.S. Atal, Amplitude optimization and pitch prediction in multipulse coders, IEEE Transactions on Acoustics, Speech, and Signal Processing (ASSP), vol. 37, No. 3, pp. 317-327, Mar. 1989.

J.P. Adoul, et al., Fast CELP coding based on algebraic codes, IEEE International Conference on Acoustics, Speech, and Signal Processing (ICASSP '87), vol. 12, pp. 1957-1960, Apr. 1987.

* cited by examiner

DASHED LINE INDICATE ALTERNATE POSSIBLE EMBODIMENTS

SUB-SAMPLED EXCITATION WAVEFORM CODEBOOKS

BACKGROUND

1. Field

The present invention relates to communication systems, and more particularly, to speech processing within communication systems.

2. Background

The field of wireless communications has many applications including, e.g., cordless telephones, paging, wireless local loops, personal digital assistants (PDAs), Internet telephony, and satellite communication systems. A particularly important application is cellular telephone systems for remote subscribers. As used herein, the term "cellular" system encompasses systems using either cellular or personal communications services (PCS) frequencies. Various over-the-air interfaces have been developed for such cellular telephone systems including, e.g., frequency division multiple access (FDMA), time division multiple access (TDMA), and code division multiple access (CDMA). In connection therewith, various domestic and international standards have been established including, e.g., Advanced Mobile Phone Service (AMPS), Global System for Mobile (GSM), and Interim Standard 95 (IS-95). IS-95 and its derivatives, IS-95A, IS-95B, ANSI J-STD-008 (often referred to collectively herein as IS-95), and proposed high-data-rate systems are promulgated by the Telecommunication Industry Association (TIA) and other well known standards bodies.

Cellular telephone systems configured in accordance with the use of the IS-95 standard employ CDMA signal processing techniques to provide highly efficient and robust cellular telephone service. Exemplary cellular telephone systems configured substantially in accordance with the use of the IS-95 standard are described in U.S. Pat. Nos. 5,103,459 and 4,901,307, which are assigned to the assignee of the present invention and incorporated by reference herein. An exemplary system utilizing CDMA techniques is the cdma2000 ITU-R Radio Transmission Technology (RTT) Candidate Submission (referred to herein as cdma2000), issued by the TIA. The standard for cdma2000 is given in the draft versions of IS-2000 and has been approved by the TIA. Another CDMA standard is the W-CDMA standard, as embodied in 3rd Generation Partnership Project "3GPP", Document Nos. 3G TS 25.211, 3G TS 25.212, 3G TS 25.213, and 3G TS 25.214.

The telecommunication standards cited above are examples of only some of the various communications systems that can be implemented. With the proliferation of digital communication systems, the demand for efficient frequency usage is constant. One method for increasing the efficiency of a system is to transmit compressed signals. Devices that employ techniques to compress speech by extracting parameters that relate to a model of human speech generation are called speech coders. A speech coder divides the incoming speech signal into blocks of time, or analysis frames. Speech coders typically comprise an encoder and a decoder. The encoder analyzes the incoming speech frame to extract certain relevant parameters, and then quantizes the parameters into binary representation, i.e., to a set of bits or a binary data packet, that is placed in an output frame. The output frames are transmitted over the communication channel in transmission channel packets to a receiver and a decoder. The decoder processes the output frames, de-quantizes them to produce the parameters, and resynthesizes the speech frames using the de-quantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, then the compression factor achieved by the speech coder is $C_r=N_i/N_o$. The challenge is to retain high voice quality of the decoded speech while achieving the target compression factor. The performance of a speech coder depends on how well the speech model, or the combination of the analysis and synthesis process described above, performs, and how well the parameter quantization process is performed at the target bit rate of $N_o$ bits per frame. The goal of the speech model is thus to capture the essence of the speech signal, or the target voice quality, with a small set of parameters for each frame.

Of the various classes of speech coder, the Code Excited Linear Predictive Coding (CELP), Stochastic Coding, or Vector Excited Speech Coding coders are of one class. An example of a coder of this particular class is described in Interim Standard 127 (IS-127), entitled, "Enhanced Variable Rate Coder" (EVRC). Another example of a coder of this particular class is described in pending draft proposal "Selectable Mode Vocoder Service Option for Wideband Spread Spectrum Communication Systems," Document No. 3GPP2 C.P9001. The function of the vocoder is to compress the digitized speech signal into a low bit rate signal by removing all of the natural redundancies inherent in speech. In a CELP coder, redundancies are removed by means of a short-term formant (or LPC) filter. Once these redundancies are removed, the resulting residual signal can be modeled as white Gaussian noise, or a white periodic signal, which also must be coded. Hence, through the use of speech analysis, followed by the appropriate coding, transmission, and re-synthesis at the receiver, a significant reduction in the data rate can be achieved.

The coding parameters for a given frame of speech are determined by first determining the coefficients of a linear prediction coding (LPC) filter. The appropriate choice of coefficients will remove the short-term redundancies of the speech signal in the frame. Long-term periodic redundancies in the speech signal are removed by determining the pitch lag, L, and pitch gain, $g_p$, of the signal. The combination of possible pitch lag values and pitch gain values is stored as vectors in an adaptive codebook. An excitation signal is then chosen from among a number of waveforms stored in an excitation waveform codebook. When the appropriate excitation signal is excited by a given pitch lag and pitch gain and is then input into the LPC filter, a close approximation to the original speech signal can be produced.

In general, the excitation waveform codebook can be stochastic or generated. A stochastic codebook is one where all the possible excitation waveforms are already generated and stored in memory. Selecting an excitation waveform encompasses a search and compare through the codebook of the stored waveforms for the "best" one. A generated codebook is one where each possible excitation waveform is generated and then compared to a performance criterion. The generated codebook can be more efficient than the stochastic codebook when the excitation waveform is sparse.

"Sparse" is a term of art indicating that only a few number of pulses are used to generate the excitation signal, rather than many. In a sparse codebook, excitation signals generally comprise a few pulses at designated positions in a "track." The Algebraic CELP (ACELP) codebook is a sparse codebook that is used to reduce the complexity of codebook searches and to reduce the number of bits required to quantize the pulse positions. The actual structure of algebraic codebooks is well known in the art and is described in the paper "Fast CELP coding based on Algebraic Codes" by J. P. Adoul, et al., Proceedings of ICASSP Apr. 6-9, 1987. The use of algebraic codes is further disclosed in U.S. Pat. No. 5,444,816, entitled "Dynamic Codebook for Efficient Speech Coding Based on Algebraic Codes", the disclosure of which is incorporated by reference.

Since a compressed speech transmission can be performed by transmitting LPC filter coefficients, an identification of the adaptive codebook vector, and an identification of the fixed codebook excitation vector, the use of a sparse codebook for the excitation vectors allows for the reallocation of saved bits to other payloads. For example, the allocated bits in an output frame for the excitation vectors can be reduced and the speech coder can then use the freed bits to reduce the granularity of the LPC coefficient quantizer.

However, even with the use of sparse codebooks, there is an ever-present need to reduce the number of bits required to convey the excitation signal information while still maintaining a high perceptual quality to the synthesized speech signal.

SUMMARY

Methods and apparatus are presented herein for reducing the number of bits needed to represent an excitation waveform without sacrificing perceptual quality. In one aspect, a method for forming an excitation waveform is presented, the method comprising: determining whether an acoustic signal in an analysis frame is a band-limited signal; if the acoustic signal is a band-limited signal, then using a sub-sampled sparse codebook to generate the excitation waveform; and if the acoustic signal is not a band-limited signal, then using a sparse codebook to generate the excitation waveform.

In another aspect, apparatus for forming an excitation waveform is presented, comprising: a memory element; and a processing element configured to execute a set of instructions stored on the memory element, the set of instructions for: determining whether an acoustic signal in an analysis frame is a band-limited signal; using a sub-sampled sparse codebook to generate the excitation waveform if the acoustic signal is a band-limited signal; and using a sparse codebook to generate the excitation waveform if the acoustic signal is not a band-limited signal.

In another aspect, a method is presented for reducing the number of bits used to represent an excitation waveform, comprising: determining a frequency characteristic of an acoustic signal; generating a sub-sampled sparse codebook waveform from a sparse codebook if the frequency characteristic indicates that sub-sampling does not impair the perceptual quality of the acoustic signal; and using the sub-sampled sparse codebook waveform to represent the excitation waveform rather than any waveform from the sparse codebook.

In another aspect, an apparatus is presented for reducing the number of bits used to represent an excitation waveform, comprising: a memory element; and a processing element configured to execute a set of instructions stored on the memory element, the set of instructions for: determining a frequency characteristic of an acoustic signal; generating a sub-sampled sparse codebook waveform from a sparse codebook if the frequency characteristic indicates that sub-sampling does not impair the perceptual quality of the acoustic signal; and using the sub-sampled sparse codebook waveform to represent the excitation waveform rather than any waveform from the sparse codebook.

In another aspect, a method is presented for generating a sub-sampled sparse codebook from a sparse codebook, wherein the sparse codebook comprises a set of permissible pulse locations, the method comprising: analyzing a frequency characteristic of an acoustic signal; and decimating a subset of permissible pulse locations from the set of permissible pulse locations of the sparse codebook in accordance with the frequency characteristic of the acoustic signal.

In another aspect, apparatus is presented for generating a sub-sampled sparse codebook from a sparse codebook, wherein the sparse codebook comprises a set of permissible pulse locations, the apparatus comprising: a memory element; and a processing element configured to execute a set of instructions stored on the memory element, the set of instructions for: analyzing a frequency characteristic of an acoustic signal; and decimating a subset of permissible pulse locations from the set of permissible pulse locations of the sparse codebook in accordance with the frequency characteristic of the acoustic signal.

In another aspect, a speech coder is presented, comprising: a linear predictive coding (LPC) unit configured to determine LPC coefficients of an acoustic signal; a frequency analysis unit configured to determine whether the acoustic signal is band-limited; a quantizer unit configured to receive the LPC coefficients and quantize the LPC coefficients; and a excitation parameter generator configured to receive a determination from the frequency analysis unit regarding whether the acoustic signal is band-limited and to implement a sub-sampled sparse codebook accordingly.

DETAILED DESCRIPTION

Figure 1:
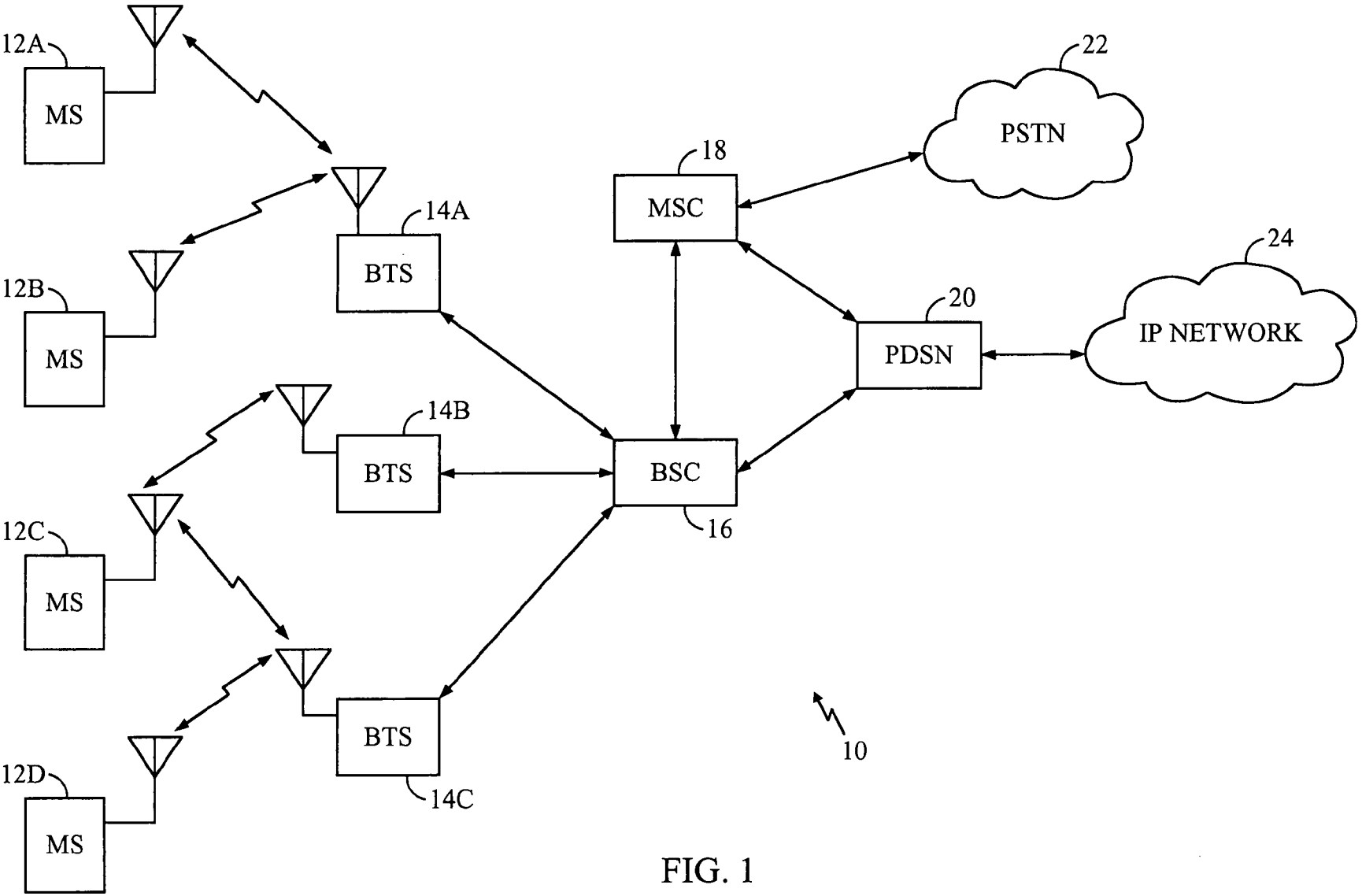
FIG. 1 is a diagram of a wireless communication system.

As illustrated in FIG. 1, a wireless communication network 10 generally includes a plurality of remote stations (also called subscriber units or mobile stations or user equipment) 12*a*-12*d*, a plurality of base stations (also called base station transceivers (BTSs) or Node B). 14*a*-14*c*, a base station controller (BSC) (also called radio network controller or packet control function 16), a mobile switching center (MSC) or switch 18, a packet data serving node (PDSN) or internetworking function (IWF) 20, a public switched telephone network (PSTN) 22 (typically a telephone company), and an Internet Protocol (IP) network 24 (typically the Internet). For purposes of simplicity, four remote stations 12*a*-12*d*, three base stations 14*a*-14*c*, one BSC 16, one MSC 18, and one PDSN 20 are shown. It would be understood by those skilled in the art that there could be any number of remote stations 12, base stations 14, BSCs 16, MSCs 18, and PDSNs 20.

In one embodiment the wireless communication network 10 is a packet data services network. The remote stations

12*a*-12*d* may be any of a number of different types of wireless communication device such as a portable phone, a cellular telephone that is connected to a laptop computer running IP-based Web-browser applications, a cellular telephone with associated hands-free car kits, a personal data assistant (PDA) running IP-based Web-browser applications, a wireless communication module incorporated into a portable computer, or a fixed location communication module such as might be found in a wireless local loop or meter reading system. In the most general embodiment, remote stations may be any type of communication unit.

The remote stations 12*a*-12*d* may advantageously be configured to perform one or more wireless packet data protocols such as described in, for example, the EIA/TIA/IS-707 standard. In a particular embodiment, the remote stations 12*a*-12*d* generate IP packets destined for the IP network 24 and encapsulates the IP packets into frames using a point-to-point protocol (PPP).

In one embodiment the IP network 24 is coupled to the PDSN 20, the PDSN 20 is coupled to the MSC 18, the MSC is coupled to the BSC 16 and the PSTN 22, and the BSC 16 is coupled to the base stations 14*a*-14*c* via wirelines configured for transmission of voice and/or data packets in accordance with any of several known protocols including, e.g., E1, T1, Asynchronous Transfer Mode (ATM), Internet Protocol (IP), Point-to-Point Protocol (PPP), Frame Relay, High-bit-rate Digital Subscriber Line (HDSL), Asymmetric Digital Subscriber Line (ADSL), or other generic digital subscriber line equipment and services (xDSL). In an alternate embodiment, the BSC 16 is coupled directly to the PDSN 20, and the MSC 18 is not coupled to the PDSN 20.

During typical operation of the wireless communication network 10, the base stations 14*a*-14*c* receive and demodulate sets of uplink signals from various remote stations 12*a*-12*d* engaged in telephone calls, Web browsing, or other data communications. Each uplink signal received by a given base station 14*a*-14*c* is processed within that base station 14*a*-14*c*. Each base station 14*a*-14*c* may communicate with a plurality of remote stations 12*a*-12*d* by modulating and transmitting sets of downlink signals to the remote stations 12*a*-12*d*. For example, as shown in FIG. 1, the base station 14*a* communicates with first and second remote stations 12*a*, 12*b* simultaneously, and the base station 14*c* communicates with third and fourth remote stations 12*c*, 12*d* simultaneously. The resulting packets are forwarded to the BSC 16, which provides call resource allocation and mobility management functionality including the orchestration of soft handoffs of a call for a particular remote station 12*a*-12*d* from one base station 14*a*-14*c* to another base station 14*a*-14*c*. For example, a remote station 12*c* is communicating with two base stations 14*b*, 14*c* simultaneously. Eventually, when the remote station 12*c* moves far enough away from one of the base stations 14*c*, the call will be handed off to the other base station 14*b*.

If the transmission is a conventional telephone call, the BSC 16 will route the received data to the MSC 18, which provides additional routing services for interface with the PSTN 22. If the transmission is a packet-based transmission such as a data call destined for the IP network 24, the MSC 18 will route the data packets to the PDSN 20, which will send the packets to the IP network 24. Alternatively, the BSC 16 will route the packets directly to the PDSN 20, which sends the packets to the IP network 24.

In a WCDMA system, the terminology of the wireless communication system components differs, but the functionality is the same. For example, a base station can also be referred to as a Radio Network Controller (RNC) operating in a UMTS Terrestrial Radio Access Network (U-TRAN), wherein "UMTS" is an acronym for Universal Mobile Telecommunications Systems.

Typically, conversion of an analog voice signal to a digital signal is performed by an encoder and conversion of the digital signal back to a voice signal is performed by a decoder. In an exemplary CDMA system, a vocoder comprising both an encoding portion and a decoding portion is collated within remote stations and base stations. An exemplary vocoder is described in U.S. Pat. No. 5,414,796, entitled "Variable Rate Vocoder," assigned to the assignee of the present invention and incorporated by reference herein. In a vocoder, an encoding portion extracts parameters that relate to a model of human speech generation. The extracted parameters are then quantized and transmitted over a transmission channel. A decoding portion re-synthesizes the speech using the quantized parameters received over the transmission channel. The model is constantly changing to accurately model the time-varying speech signal.

Thus, the speech is divided into blocks of time, or analysis frames, during which the parameters are calculated. The parameters are then updated for each new frame. As used herein, the word "decoder" refers to any device or any portion of a device that can be used to convert digital signals that have been received over a transmission medium. The word "encoder" refers to any device or any portion of a device that can be used to convert acoustic signals into digital signals. Hence, the embodiments described herein can be implemented with vocoders of CDMA systems, or alternatively, encoders and decoders of non-CDMA systems.

The Code Excited Linear Predictive (CELP) coding method is used in many speech compression algorithms, wherein a filter is used to model the spectral magnitude of the speech signal. A filter is a device that modifies the frequency spectrum of an input waveform to produce an output waveform. Such modifications can be characterized by the transfer function H(f)=Y(f)/X(f), which relates the modified output waveform y(t) to the original input waveform x(t) in the frequency domain.

With the appropriate filter coefficients, an excitation signal that is passed through the filter will result in a waveform that closely approximates the speech signal. Since the coefficients of the filter are computed for each frame of speech using linear prediction techniques, the filter is subsequently referred to as the Linear Predictive Coding (LPC) filter. The filter coefficients are the coefficients of the transfer function:

$$A(z) = 1 - \sum_{i=1}^{L} A_i z^{-1},$$

wherein L is the order of the LPC filter.

Once the LPC filter coefficients $A_i$ have been determined, the LPC filter coefficients are quantized and transmitted to a destination, which will use the received parameters in a speech synthesis model.

Figure 2:
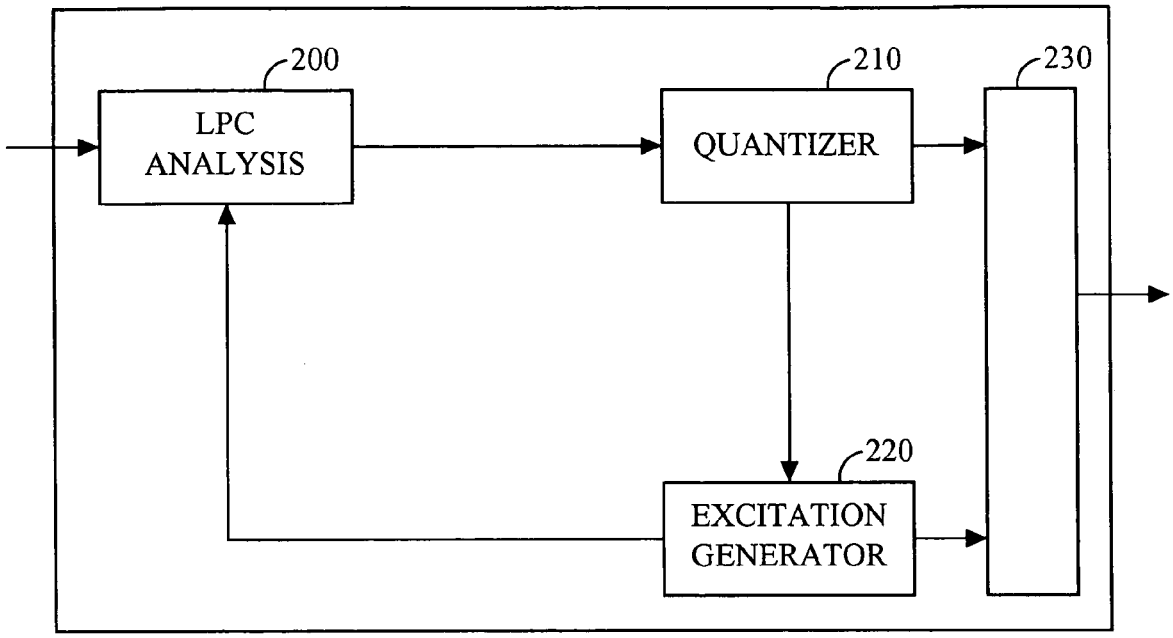
FIG. 2 is a block diagram of the functional components of a general linear predictive speech coder.

FIG. 2 is a block diagram of the functional components of a general linear predictive speech coder. A speech analysis frame is input to an LPC Analysis Unit 200 to determine LPC coefficients and input into an Excitation Parameter Generator 220 to help generate an excitation vector. The LPC coefficients are input to a Quantizer 210 to quantize the LPC coefficients. The output of the Quantizer 210 is also used by the Excitation Parameter Generator 220 to generate the excitation vector. (For adaptive systems, the output of the Excitation Parameter Generator 220 is input into the LPC Analysis Unit 200 in order to find a closer filter approximation to the original signal using the newly generated excitation waveform.)

The LPC Analysis Unit 200, Quantizer 210 and the Excitation Parameter Generator 220 are used together to generate optimal excitation vectors in an analysis-by-synthesis loop, wherein a search is performed through candidate excitation vectors in order to select an excitation vector that minimizes the difference between the input speech signal and the synthesized signal. Note that other representations of the input speech signal can be used as the basis for selecting an excitation vector. For example, an excitation vector can be selected that minimizes the difference between a weighted speech signal and a synthesized signal. When the synthesized signal is within a system-defined tolerance of the original acoustic signal, the output of the Excitation Parameter Generator 220 and the Quantizer 210 are input into a multiplexer element 230 in order to be combined. The output of the multiplexer element 230 is then encoded and modulated for transmission over a channel to a receiver.

Other functional components may be inserted in the apparatus of FIG. 2 that is appropriate to the type of speech coder used. For example, in variable rate vocoders, a Rate Selection Unit may be included to select an output frame size/rate, i.e., full rate frame, half rate frame, quarter rate frame, or eighth rate frame, based on the activity levels of the input speech. The information from the Rate Selection Unit could then be used to select a quantization scheme that is best suited for each frame size at the Quantizer 210. A detailed description of a variable rate vocoder is presented in U.S. Pat. No. 5,414,796, entitled, "Variable Rate Vocoder," which is assigned to the assignee of the present invention and incorporated by reference herein.

The embodiments that are described herein are for improving the flexibility of the speech coder to reallocate bit loads between the LPC quantization bits and the excitation waveform bits of the output frame. In one embodiment, the number of bits needed to represent the excitation waveform is reduced by using a sub-sampled sparse codebook. The bits that are not needed to represent the waveform from the sub-sampled sparse codebook can then be reallocated to the LPC quantization schemes or other speech coder parameters (not shown), which will in turn improve the acoustical quality of the synthesized signal. The constraints that are imposed upon the sub-sampled sparse codebook are derived from an analysis of the frequency characteristics displayed by the input frame.

An excitation vector in a sparse codebook takes the form of pulses that are limited to permissible locations. The spacing is such that each position has a chance to contain a non-zero pulse. Table 1 is an example of a sparse codebook of excitation vectors that comprise four (4) pulses for each vector. For this particular sparse codebook, which is known as the ACELP Fixed Codebook, there are 64 possible bit positions in an excitation vector of length 64. Each pulse is allowed to occupy any one of sixteen (16) positions. The sixteen positions are equidistantly spaced.

TABLE 1

Possible Pulse Locations of an ACELP Fixed Codebook Track

| Pulse | Possible pulse locations for each pulse | | | | | | | | | | | | | | | |
|---|---|---|---|---|---|---|---|---|---|---|---|---|---|---|---|---|
| A | 0 | 4 | 8 | 12 | 16 | 20 | 24 | 28 | 32 | 36 | 40 | 44 | 48 | 52 | 56 | 60 |
| B | 1 | 5 | 9 | 13 | 17 | 21 | 25 | 29 | 33 | 37 | 41 | 45 | 49 | 53 | 57 | 61 |
| C | 2 | 6 | 10 | 14 | 18 | 22 | 26 | 30 | 34 | 38 | 42 | 46 | 50 | 54 | 58 | 62 |
| D | 3 | 7 | 11 | 15 | 19 | 23 | 27 | 31 | 35 | 39 | 43 | 47 | 51 | 55 | 59 | 63 |

As can be noted from Table 1, all possible pulse positions of the subframe, i.e., positions 0 through 63, are simultaneously likely to be occupied by either pulse A, pulse B, pulse C, or pulse D. As used herein, "track" refers to the permissible locations for each respective pulse, while "subframe" refers to all pulse positions of a specified length. If pulse A is constrained so that it is only permitted to occupy a position at location 0, 4, 8, 12, 16, 20, 24, 28, 32, 36, 40, 44, 48, 52, 56, or 60 in the subframe, then there are 16 possible candidate positions in the track. The number of bits needed to code a pulse position would be $\log_2(16)=4$. Therefore, the total number of bits required to identify the 4 positions of the 4 pulses would be $4\times4=16$. If there are 4 subframes that are required for each analysis frame of the speech coder, then $4\times16=64$ bits would be needed to code the above ACELP fixed codebook vector.

The embodiments that are described herein are for generating excitation waveforms with constraints imposed by specific signal characteristics. The embodiments may also be used for excluding certain candidate waveforms from a candidate search through a stochastic excitation waveform codebook. Hence, the embodiments can be implemented in relation to either codebook generation or stochastic codebook searches. For the purpose of illustrative ease, the embodiments are described in relation to ACELP, which involves codebook generation, rather than codebook searches through tables. However, it should be noted that scope of the embodiments extends over both. Hence, "codebook generation" and "codebook search" will be simplified to "codebook" hereinafter. In one embodiment, a spectral analysis scheme is used in order to selectively delete or exclude possible pulse positions from the codebook. In another embodiment, a voice activity detection scheme is used to selectively delete or exclude possible pulse positions from the codebook. In another embodiment, a zero-crossing scheme is used to selectively delete or exclude possible pulse positions from the codebook.

As is generally known in the art, an acoustic signal often has a frequency spectrum that can be classified as low-pass, band-pass, high-pass or stop-band. For example, a voiced speech signal generally has a low-pass frequency spectrum while an unvoiced speech signal generally has a high-pass frequency spectrum. For low-pass signals, a frequency die-off occurs at the higher end of the frequency range. For band-pass signals, frequency die-offs occur at the low end of the frequency range and the high end of the frequency range. For stop-band signals, frequency die-offs occur in the middle of the frequency range. For high-pass signals, a frequency die-off occurs at the low end of the frequency range. As used herein, the term "frequency die-off" refers to a substantial reduction in the magnitude of frequency spectrum within a narrow frequency range, or alternatively, an area of the frequency spectrum wherein the magnitude is less than a threshold value. The actual definition of the term is dependent upon the context in which the term is used herein.

The embodiments are for determining the type of frequency spectrum exhibited by the acoustic signal in order to selectively delete or omit pulse position information from the codebook. The bits that would otherwise be allocated to the deleted pulse position information can then be re-allocated to the quantization of LPC coefficients or other parameter information, which results in an improvement of the perceptual quality of the synthesized acoustic signal. Alternatively, the bits that would have been allocated to the deleted or omitted pulse position information are dropped from consideration, i.e., those bits are not transmitted, resulting in an overall reduction in the bit rate.

Once a determination of the spectral characteristics of an analysis frame is made, then a sub-sampled pulse codebook structure can be generated based on the spectral characteristics. In one embodiment, a sub-sampled pulse codebook can be implemented based on whether the analysis frame encompasses a low-pass frequency signal or not. According to the Nyquist Sampling Theorem, a signal that is bandlimited to B Hertz can be exactly reconstructed from its samples when it is periodically sampled at a rate $f_s \geqq 2B$. Correspondingly, one may decimate a low-pass frequency signal without loss of spectral integrity at the appropriate sampling rate. Depending upon the sampling rate, the same assertion can be made for any band-pass signal.

Hence, for frames that have been identified as containing a band-limited, i.e., a low-pass or band-pass, signal, the number of possible pulse positions can be further constrained to a number less than the subframe size. To the example of Table 1, a further constraint can be imposed, such as an a priori decision to allow the pulses to be located only in the even pulse positions of a track. Table 2 is an example of this further constraint.

TABLE 2

Possible Pulse Locations (Even) of a Sub-Sampled ACELP Fixed Codebook

| Pulse | Possible Pulse Positions | | | | | | | |
|---|---|---|---|---|---|---|---|---|
| A | 0 | 8 | 16 | 24 | 32 | 40 | 48 | 56 |
| B | 2 | 10 | 18 | 26 | 34 | 42 | 50 | 58 |
| C | 4 | 12 | 20 | 28 | 36 | 44 | 52 | 60 |
| D | 6 | 14 | 22 | 30 | 38 | 46 | 54 | 62 |

Another option is to make an a priori decision to allow a pulse to be located only in the odd pulse positions of a track. Table 3 is an example of this alternative constraint.

TABLE 3

Possible Pulse Locations (Odd) of a Sub-Sampled ACELP Fixed Codebook

| Pulse | Possible Pulse Positions | | | | | | | |
|---|---|---|---|---|---|---|---|---|
| A | 1 | 9 | 17 | 25 | 33 | 41 | 49 | 57 |
| B | 3 | 11 | 19 | 27 | 35 | 43 | 51 | 59 |
| C | 5 | 13 | 21 | 29 | 37 | 45 | 53 | 61 |
| D | 7 | 15 | 23 | 31 | 39 | 47 | 55 | 63 |

In the sub-sampled pulse positions of Table 2 and Table 3, each pulse is constrained to one of eight pulse positions. Hence, the number of bits needed to code each pulse position would be $\log_2(8)=3$ bits. The total number of bits for all four (4) pulses in a subframe would be 4×3=12 bits. If there are four (4) such subframes for each analysis frame, the total number of bits for each analysis frame is 4×12=48 bits. Hence, for an ACELP fixed codebook vector, there would be a reduction from 64 bits to 48 bits, which is a bit reduction of 25%. Since approximately 20% of all speech comprises low-pass signals, there is a significant reduction in the overall number of bits needed to transmit codebook vectors for a conversation.

In an alternative embodiment, a decision can be made as to the type of constraint after a position search is conducted for the optimal excitation waveform. For example, an a posteriori constraint such as allowing all even positions OR allowing all odd positions can be imposed after an initial codebook search/generation. Hence, a decimation of an even track and a decimation of an odd track would be undertaken if the signal is low-pass or band-pass, a search for the best pulse position would be conducted for each decimated track, and then a determination is made as to which is better suited for acting as the excitation waveform. Another type of a posteriori constraint would be to position the pulses according to the old rules (such as shown in Table 1, for example), make a secondary decision as to whether the pulses are in mostly even or mostly odd positions, and then decimate the selected track if the signal is a low-pass or band-pass signal. The secondary decisions as to the best pulse positions can be based upon signal to noise ratio (SNR) measurements, energy measurements of error signals, signal characteristics, other criterion or a combination thereof.

Using the above alternative embodiment, an extra bit would be needed to indicate whether an even or odd sub-sampling occurred. Even though the number of bits needed to represent the sub-sampling is still $\log_2(8)=3$ bits, the number of bits needed to represent each waveform, with the even or odd sub-sampling, would be 4×3+1=13 bits. When four (4) subframes are used for each analysis frame, then 4×13=52 bits would be needed to code the ACELP fixed codebook vector, which is still a significant reduction from the original 64 bits of the sparse ACELP codebook.

Note that the bit-savings derives from the reduction of the number of bits needed to represent the excitation waveform. The length of some of the excitation waveforms is shortened, but the number of excitation waveforms in the codebook remains the same.

Various methods and apparatus can be used to determine the frequency characteristics exhibited by the acoustic signal in order to selectively delete pulse position information from the codebook. In one embodiment, a classification of the acoustic signal within a frame is performed to determine whether the acoustic signal is a speech signal, a nonspeech signal, or an inactive speech signal. This determination of voice activity can then be used to decide whether a sub-sampled sparse codebook should be used, rather than a sparse codebook. Examples of inactive speech signals are silence, background noise, or pauses between words. Nonspeech may comprise music or other nonhuman acoustic signal. Speech can comprise voiced speech, unvoiced speech or transient speech.

Voiced speech is speech that exhibits a relatively high degree of periodicity. The pitch period is a component of a speech frame and may be used to analyze and reconstruct the contents of the frame. Unvoiced speech typically comprises consonant sounds. Transient speech frames are typically transitions between voiced and unvoiced speech. Speech frames that are classified as neither voiced nor unvoiced speech are classified as transient speech. It would be understood by those skilled in the art that any reasonable classification scheme could be employed. Various methods exist for determining upon the type of acoustic activity that may be carried by the frame, based on such factors as the energy content of the frame, the periodicity of the frame, etc.

Hence, once a speech classification is made that an analysis frame is carrying voiced speech, an Excitation Parameter Generator can be configured to implement a sub-sampled sparse codebook rather then the normal sparse codebook. Note that the some voiced speech can be band-pass signals and that using the appropriate speech classification algorithm will catch these signals as well. Various methods of performing speech classification exist. Some of them are described in co-pending U.S. patent application Ser. No. 09/733,740, entitled, "METHOD AND APPARATUS FOR ROBUST SPEECH CLASSIFICATION," which is incorporated by reference herein and assigned to the assignee of the present invention.

One technique for performing a classification of the voice activity is by interpreting the zero-crossing rates of a signal. The zero-crossing rate is the number of sign changes in a speech signal per frame of speech. In voiced speech, the zero-crossing rate is low. In unvoiced speech, the zero-crossing rate is high. "Low" and "high" can be defined by predetermined threshold amounts or by variable threshold amounts. Based upon this technique, a low zero-crossing rate implies that voiced speech exists in the analysis frame, which in turn implies that the analysis frame contains a low-pass signal or a band-pass signal.

Another technique for performing a classification of voice activity is by performing energy comparisons between a low frequency band (for example, 0-2 kHz) and a high frequency band (for example, 2 kHz-4 kHz). The energy of each band is compared to each other. In general, voiced speech concentrates energy in the low band, and unvoiced speech concentrates energy in the high band. Hence, the band energy ratio would skew to one high or low depending upon the nature of the speech signal.

Another technique for performing a classification of voice activity is by comparing low band and high band correlations. Auto-correlation computations can be performed on a low band portion of signal and on the high band portion of the signal in order to determine the periodicity of each section. Voiced speech displays a high degree of periodicity, so that a computation indicating a high degree of periodicity in the low band would indicate that using a sub-sampled sparse codebook to code the signal would not degrade the perceptual quality of the signal.

In another embodiment, rather than inferring the presence of a low pass signal from a voice activity level, a direct analysis of the frequency characteristics of the analysis frame can be performed. Spectrum analysis can be used to determine whether a specified portion of the spectrum is perceptually insignificant by comparing the energy of the specified portion of the spectrum to the entire energy of the spectrum. If the energy ratio is less than a predetermined threshold, then a determination is made that the specified portion of the spectrum is perceptually insignificant. Conversely, a determination that a portion of the spectrum is perceptually significant can also be performed.

Figure 3:
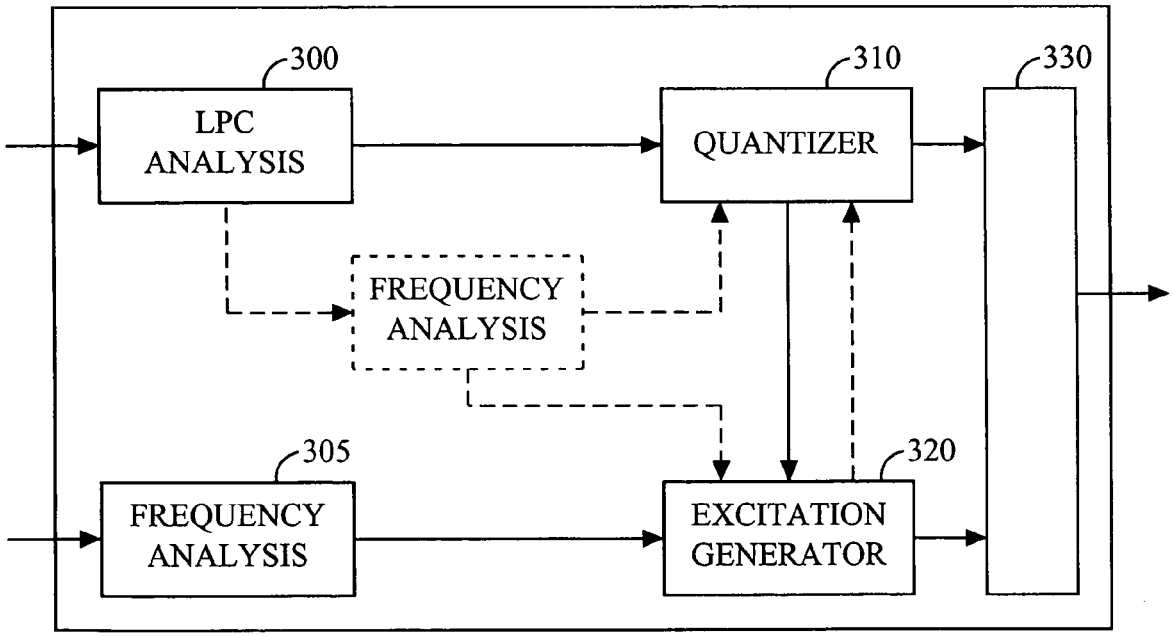
FIG. 3 is a block diagram of the functional components of a linear predictive speech coder that is configured to use a sub-sampled sparse codebook.

FIG. 3 is a functional block diagram of a linear predictive speech coder that is configured to use a sub-sampled sparse codebook. A speech analysis frame is input to an LPC Analysis Unit 300 to determine LPC coefficients. The LPC coefficients are input to a Quantizer 310 to quantize the LPC coefficients. The LPC coefficients are also input into a Frequency Analysis Unit 305 in order to determine whether the analysis frame contains a low-pass signal or a band-pass signal. The Frequency Analysis Unit 305 can be configured to perform classifications of speech activity in order to indirectly determine whether the analysis frame contains a band-limited (i.e., low-pass or band-pass) signal or alternatively, the Frequency Analysis Unit 305 can be configured to perform a direct spectral analysis upon the input acoustic signal. In an alternative embodiment, the Frequency Analysis Unit 305 can be configured to receive the acoustic signal directly and need not be coupled to the LPC Analysis Unit 300.

The output of the Frequency Analysis Unit 305 and the output of the Quantizer 310 are used by an Excitation Parameter Generator 320 to generate an excitation vector. The Excitation Parameter Generator 320 is configured to use either a sparse codebook or a sub-sampled sparse codebook, as described above, to generate the excitation vector. (For adaptive systems, the output of the Excitation Parameter Generator 320 is input into the LPC Analysis Unit 300 in order to find a closer filter approximation to the original signal using the newly generated excitation waveform.) Alternatively, the Excitation Parameter Generator 320 and the Quantizer 310 are further configured to interact if a sub-sampled sparse codebook is selected. If a sub-sampled sparse codebook is selected, then more bits are available for use by the speech coder. Hence, a signal from the Excitation Parameter Generator 320 indicating the use of a sub-sampled sparse codebook allows the Quantizer 310 to reduce the granularity of the quantization scheme, i.e., the Quantizer 310 may use more bits to represent the LPC coefficients. Alternatively, the bit-savings may be allocated to other components (not shown) of the speech coder.

Alternatively, the Quantizer 310 may be configured to receive a signal from the Frequency Analysis Unit 305 regarding the characteristics of the acoustic signal and to select a granularity of the quantization scheme accordingly.

The LPC Analysis Unit 300, Frequency Analysis Unit 305, Quantizer 310 and the Excitation Parameter Generator 320 may be used together to generate optimal excitation vectors in an analysis-by synthesis loop, wherein a search is performed through candidate excitation vectors in order to select an excitation vector that minimizes the difference between the input speech signal and the synthesized signal. When the synthesized signal is within a system-defined tolerance of the original acoustic signal, the output of the Excitation Parameter Generator 320 and the Quantizer 310 are input into a multiplexer element 330 in order to be combined. The output of the multiplexer element 330 is then encoded and modulated for transmission over a channel to a receiver. Control elements, such as processors and memory (not shown), are communicatively coupled to the functional blocks of FIG. 3 to control the operations of said blocks. Note that the functional blocks can be implemented either as discrete hardware components or as software modules executed by a processor and memory.

Figure 4:
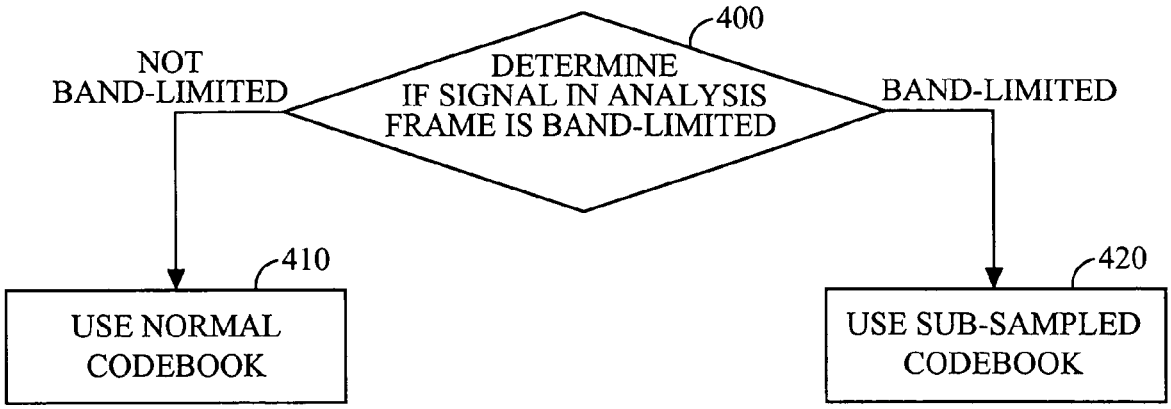
FIG. 4 is a flowchart for forming an excitation waveform in accordance with an a priori constraint.

FIG. 4 is a flowchart for forming an excitation waveform in accordance with the a priori constraints described above. At step 400, the content of an input frame is analyzed to determine whether the content is a low-pass or band-pass signal. If the content is not low-pass or band-pass, then the program flow proceeds to step 410, wherein a normal codebook is used to select an excitation waveform. If the content is low-pass or band-pass, then the program flow proceeds to step 420, wherein a sub-sampled codebook is used to select an excitation waveform.

The sub-sampled codebook used at step 420 is generated by decimating a subset of possible pulse positions in the codebook. The generation of the sub-sampled codebook may be initiated by the analysis of the spectral characteristics or may be pre-stored. The analysis of the input frame contents may be performed in accordance with any of the analysis methods described above.

Figure 5:
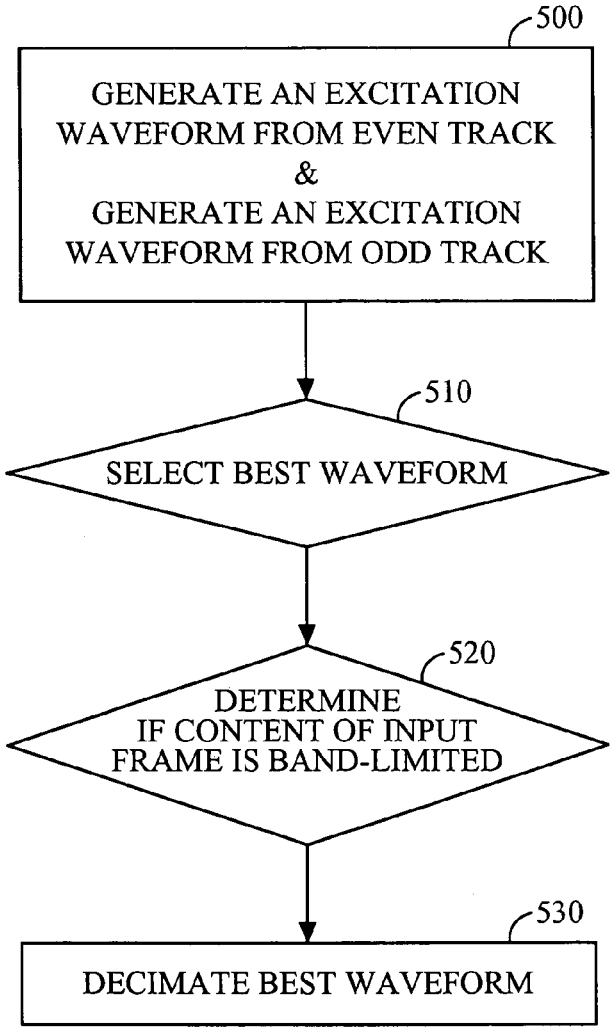
FIG. 5 is a flowchart for forming an excitation waveform in accordance with an a posteriori constraint.

FIG. 5 is a flowchart for forming an excitation waveform in accordance with one of the a posteriori constraints above. At step 500, an excitation waveform is generated/selected from an even track of a codebook and an excitation waveform is generated/selected from an odd track of the codebook. Note that the codebook may be stochastic or generated. At step 510, a decision is made to select either the even excitation waveform or the odd excitation waveform. The decision may be based on the largest SNR value, smallest error energy, or some other criterion. At step 520, a first decision is made as to whether the content of the input frame is a low-pass or band-pass signal. If the content of the input frame is not a low-pass or band-pass signal, then the program flow ends. If the content of the input frame is a low-pass or band-pass signal, then the program flow proceeds to step 530. At step 530, the selected excitation waveform is decimated. A bit indicating whether the selected waveform is even or odd is added to the excitation waveform parameters.

Figure 6:
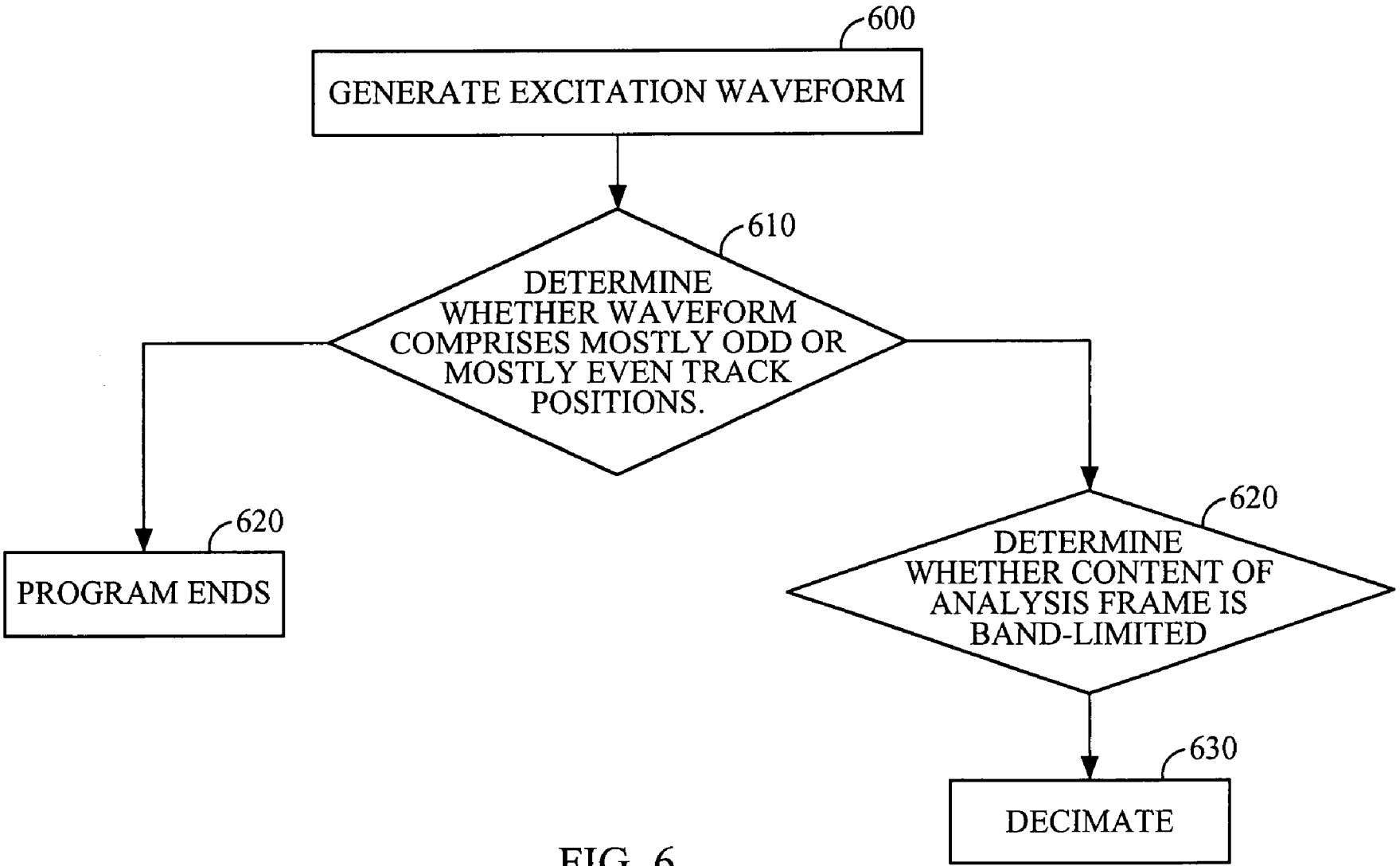
FIG. 6 is a flowchart for forming an excitation waveform in accordance with another a posteriori constraint.

FIG. 6 is a flowchart for forming an excitation waveform in accordance with one of the a posteriori constraints above. At step 600, an excitation waveform is generated according to an already established methodology, such as, for example, ACELP. At step 610, a first decision is made as to whether the excitation waveform comprises mostly odd or mostly even track positions. If the excitation waveform has either mostly odd or mostly even track positions, the program flow proceeds to step 620, else, the program flow ends. At step 620, a second decision is made as to whether the content of the input frame is a low-pass or band-pass signal. If the content of the input frame is not a low-pass nor band-pass signal, then the program flow ends. If the content of the input frame is a low-pass or band-pass signal, then the program flow proceeds to step 630. At step 630, the selected excitation waveform is decimated. A bit indicating whether the selected waveform is even or odd is added to the excitation waveform parameters.

The above embodiments have been described generically so that they could be applied to variable rate vocoders, fixed rate vocoders, narrowband vocoders, wideband vocoders, or other types of coders without affecting the scope of the embodiments. The embodiments can help reduce the amount of bits needed to convey speech information to another party by reducing the number of bits needed to represent the excitation waveform. The bit-savings can be used to either reduce the size of the transmission payload or the bit-savings can be spent on other speech parameter information or control information. Some vocoders, such as wideband vocoders, would particularly benefit from the ability to reallocate bit-savings to other parameter information. Wideband vocoders encode a wider frequency range (7 kHz) of the input acoustic signal than narrowband vocoders (4 kHz), so that the extra bandwidth of the signal requires higher coding bit rates than a conventional narrowband signal. Hence, the bit reduction techniques described above can help reduce the coding bit rate of the wideband voice signals without sacrificing the high quality associated with the increased bandwidth.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method for forming an excitation waveform in a speech coder, the method comprising:

determining whether an acoustic signal in an analysis frame is a band-limited signal;

if the acoustic signal is a band-limited signal, then using a sub-sampled sparse codebook to generate the excitation waveform, wherein the sub-sampled sparse codebook comprises either only even track positions or only odd track positions from the sparse codebook; and if the acoustic signal is not a band-limited signal, then using a sparse codebook to generate the excitation waveform, wherein the sparse codebook comprises a set of predetermined possible positions and the sub-sampled sparse code book comprises a subset of the predetermined positions, such that the excitation waveform is generated through placement of pulses within the predetermined positions or the subset; and wherein using the sub-sampled sparse codebook to generate the excitation waveform comprises generating an initial excitation waveform, determining whether the initial excitation waveform comprises mostly odd track positions or mostly even track positions, and decimating the initial excitation waveform to generate the excitation waveform.

2. The method of claim 1, wherein determining whether an acoustic signal in an analysis frame is a band-limited signal comprises:

determining a voice activity level of the acoustic signal; and using the voice activity level to determine whether the acoustic signal is a band-limited signal.

3. The method of claim 1, wherein determining whether an acoustic signal in an analysis frame is a band-limited signal comprises:

comparing an energy level of a low frequency band of the acoustic signal to an energy level of a high frequency band of the acoustic signal; and if the energy level of the low frequency band of the acoustic signal is higher than the energy level of the high frequency band of the acoustic signal, then deciding that the acoustic signal is a band-limited signal.

4. The method of claim 1, wherein determining whether an acoustic signal in an analysis frame is a band-limited signal comprises:

determining a zero-crossing rate for the acoustic signal; and if the zero-crossing rate is low, then deciding that the acoustic signal is a band-limited signal.

5. The method of claim 1, wherein determining whether an acoustic signal in an analysis frame is a band-limited signal comprises:

determining the periodicity of a low frequency band of the acoustic signal; and if the periodicity of the low frequency band of the acoustic signal is high, then deciding that the acoustic signal is a band-limited signal.

6. The method of claim 1, wherein determining whether an acoustic signal in an analysis frame is a band-limited signal comprises:

analyzing the spectral content of the acoustic signal for a significant band-limited component.

7. The method of claim 1, further comprising:

determining at least one of a spectral content, voice activity and zero-crossing rate of the acoustic signal; and based on determining at least one of the spectral content, voice activity and zero-crossing rate of the acoustic signal, generating the sub-sampled sparse codebook.

8. The method of claim 1, further comprising excluding certain candidate excitation waveforms from a search through a stochastic excitation waveform codebook.

9. The method of claim 1, if the acoustic signal is band-limited, further comprising reallocating bits, which would have been used to represent an excitation waveform from the sparse codebook, to represent another speech encoding parameter.

10. The method of claim 9, wherein the speech encoding parameter comprises a linear predictive coding (LPC) filter coefficient.

11. The method of claim 1, further comprising:

generating multiple candidate excitation waveforms based on different sub-sampled sparse codebooks; and determining which of the multiple candidate excitation waveforms is better suited for acting as the excitation waveform.

12. Apparatus for forming an excitation waveform, comprising:

a memory element; and a processing element configured to execute a set of instructions stored on the memory element, the set of instructions for:

determining whether an acoustic signal in an analysis frame is a band-limited signal;

using a sub-sampled sparse codebook to generate the excitation waveform if the acoustic signal is a band-limited signal, wherein the sub-sampled sparse codebook comprises either only even track positions or only odd track positions from a sparse codebook; and using the sparse codebook to generate the excitation waveform if the acoustic signal is not a band-limited signal, wherein the sparse codebook comprises a set of predetermined possible positions and the sub-sampled sparse code book comprises a subset of the predetermined positions, such that the excitation waveform is generated through placement of pulses within the predetermined positions or the subset; and wherein using the sub-sampled sparse codebook to generate the excitation waveform comprises generating an initial excitation waveform, determining whether the initial excitation waveform comprises mostly odd track positions or mostly even track positions, and decimating the initial excitation waveform to generate the excitation waveform.

13. The apparatus of claim 12, wherein the apparatus is a wideband vocoder.

14. The apparatus of claim 12, wherein the apparatus is a narrowband vocoder.

15. The apparatus of claim 12, wherein the apparatus is a variable rate vocoder.

16. The apparatus of claim 12, wherein the apparatus is a fixed rate vocoder.

17. An apparatus for forming an excitation waveform, comprising:

means for determining whether an acoustic signal in an analysis frame is a band-limited signal;

means for using a sub-sampled sparse codebook to generate the excitation waveform if the acoustic signal is a band-limited signal, wherein the sub-sampled sparse codebook comprises either only even track positions or only odd track positions from a sparse codebook; and means for using the sparse codebook to generate the excitation waveform if die acoustic signal is not a band-limited signal, wherein the sparse codebook comprises a set of predetermined possible positions and the sub-sampled sparse codebook comprises a subset of the predetermined positions, such that die excitation waveform is generated through placement of pulses within the predetermined positions or the subset;

wherein using the sub-sampled sparse codebook to generate the excitation waveform comprises generating an initial excitation waveform, determining whether the initial excitation waveform comprises mostly odd track positions or mostly even track positions, and decimating the initial excitation waveform to generate the excitation waveform.

18. The apparatus of claim 17, wherein the apparatus is a wideband vocoder.

19. A method for a signal coder to reduce the number of bits used to represent an excitation waveform, comprising:

determining a frequency characteristic of an acoustic signal;

generating a sub-sampled sparse codebook waveform from a sparse codebook if the frequency characteristic indicates that sub-sampling does not impair the perceptual quality of the acoustic signal, wherein the sparse codebook comprises a set of predetermined possible positions and the sub-sampled sparse code book comprises a subset of the predetermined positions, such that the excitation waveform is generated through placement of pulses within the predetermined positions or the subset, wherein the sub-sampled sparse codebook comprises either only even track positions or only odd track positions from the sparse codebook; and using the sub-sampled sparse codebook waveform to represent the excitation waveform rather than a waveform from the sparse codebook;

wherein using the sub-sampled sparse codebook to represent the excitation waveform comprises generating an initial excitation waveform, determining whether the initial excitation waveform comprises mostly odd track positions or mostly even track positions, and decimating the initial excitation waveform.

20. Apparatus for reducing the number of bits used to represent an excitation waveform, comprising:

a memory element; and a processing element configured to execute a set of instructions stored on the memory element, the set of instructions for:

determining a frequency characteristic of an acoustic signal;

generating a sub-sampled sparse codebook waveform from a sparse codebook if the frequency characteristic indicates that sub-sampling does not impair the perceptual quality of the acoustic signal, wherein the sparse codebook comprises a set of predetermined possible positions and the sub-sampled sparse code book comprises a subset of the predetermined positions, such that the excitation waveform is generated through placement of pulses within the predetermined positions or the subset, wherein the sub-sampled sparse codebook comprises either only even track positions or only odd track positions from the sparse codebook; and using the sub-sampled sparse codebook waveform to represent the excitation waveform rather than a waveform from the sparse codebook;

wherein using the sub-sampled sparse codebook to represent the excitation waveform comprises generating an initial excitation waveform, determining whether the initial excitation waveform comprises mostly odd track positions or mostly even track positions, and decimating the initial excitation waveform.

21. An apparatus for reducing the number of bits used to represent an excitation waveform, comprising:

means for determining a frequency characteristic of an acoustic signal;

means for generating a sub-sampled sparse codebook waveform from a sparse codebook if the frequency characteristic indicates that sub-sampling does not impair the perceptual quality of the acoustic signal, wherein the sparse codebook comprises a set of predetermined possible positions and the sub-sampled sparse code book comprises a subset of the predetermined positions, such that the excitation waveform is generated through placement of pulses within the predetermined positions or the subset, wherein the sub-sampled sparse codebook comprises either only even track positions or only odd track positions from the sparse codebook; and means for using the sub-sampled sparse codebook waveform to represent the excitation waveform rather than a waveform from the sparse codebook;

wherein using the sub-sampled sparse codebook waveform to represent the excitation waveform comprises generating an initial excitation waveform, determining whether the initial excitation waveform comprises mostly odd track positions or mostly even track positions, and decimating the initial excitation waveform.

22. The apparatus of claim 21, wherein the apparatus is a wideband vocoder.

23. The apparatus of claim 21, wherein the apparatus is a narrowband vocoder.

24. The apparatus of claim 21, wherein the apparatus is a variable rate vocoder.

25. The apparatus of claim 21, wherein the apparatus is a fixed rate vocoder.

26. A method for execution by a suitably programmed processor to generate a sub-sampled sparse codebook from a sparse codebook, wherein the sparse codebook comprises pulses at a set of permissible pulse locations, the method comprising:

analyzing a frequency characteristic of an acoustic signal;

determining whether an initial excitation waveform corresponding to the acoustic signal comprises mostly odd track positions or mostly even track positions; and decimating a subset of permissible pulse locations from the set of permissible pulse locations of the sparse codebook in accordance with the frequency characteristic of the acoustic signal to generate the sub-sampled sparse codebook, wherein the sub-sampled sparse codebook comprises either only even track positions or only odd track positions from the sparse codebook.

27. Apparatus for generating a sub-sampled sparse codebook from a sparse codebook, wherein the sparse codebook comprises pulses at a set of permissible pulse locations, the apparatus comprising:

a memory element; and a processing element configured to execute a set of instructions stored on the memory element, the set of instructions for:

analyzing a frequency characteristic of an acoustic signal;

determining whether an initial excitation waveform corresponding to the acoustic signal comprises mostly odd track positions or mostly even track positions; and decimating a subset of permissible pulse locations from the set of permissible pulse locations of the sparse codebook in accordance with the frequency characteristic of the acoustic signal to generate the sub-sampled sparse codebook, wherein the sub-sampled sparse codebook comprises either only even track positions or only odd track positions from the sparse codebook.

28. Apparatus for generating a sub-sampled sparse codebook from a sparse codebook, wherein the sparse codebook comprises pulses at a set of permissible pulse locations, the apparatus comprising:

means for analyzing a frequency characteristic of an acoustic signal;

means for determining whether an initial excitation waveform corresponding to the acoustic signal comprises mostly odd track positions or mostly even track positions; and means for decimating a subset of permissible pulse locations from the set of permissible pulse locations of the sparse codebook in accordance with the frequency characteristic of the acoustic signal to generate the sub-sampled sparse codebook, wherein the sub-sampled sparse codebook comprises either only even track positions or only odd track positions from the sparse codebook.

29. The apparatus of claim 28, wherein the apparatus is a wideband vocoder.

30. The apparatus of claim 28, wherein the apparatus is a narrowband vocoder.

31. The apparatus of claim 28, wherein the apparatus is a variable rate vocoder.

32. The apparatus of claim 28, wherein the apparatus is a fixed rate vocoder.

33. A speech coder, comprising:

a linear predictive coding (LPC) unit configured to determine LPC coefficients of an acoustic signal;

a frequency analysis unit configured to determine whether the acoustic signal is band-limited;

a quantizer unit configured to receive the LPC coefficients to and quantize the LPC coefficients; and an excitation parameter generator configured to receive a determination from the frequency analysis unit regarding whether the acoustic signal is band-limited and to implement a sub-sampled sparse codebook, the sparse codebook comprising a set of predetermined possible positions and the sub-sampled sparse code book comprising a subset of the predetermined positions, wherein the sub-sampled sparse codebook comprises either only even track positions or only odd track positions from the sparse codebook, and wherein implementing the sub-sampled sparse codebook comprises determining whether an initial excitation waveform comprises mostly odd track positions or mostly even track positions.

34. The speech coder of claim 33, wherein the quantizer unit is further configured to receive the determination from the frequency analysis unit regarding whether the acoustic signal is band-limited and to update the quantization scheme accordingly.

35. The speech coder of claim 33, wherein the quantizer unit is further configured to receive information from the excitation parameter generator regarding the implementation of the sub-sampled sparse codebook and to update the quantization scheme accordingly.

36. A computer-program product comprising a computer-readable medium having instructions thereon, the instructions comprising:

code for determining whether an acoustic signal in an analysis frame is a band-limited signal;

code for using a sub-sampled sparse codebook to generate an excitation waveform if the acoustic signal is a band-limited signal, wherein the sub-sampled sparse codebook comprises either only even track positions or only odd track positions from a sparse codebook; and code for using the sparse codebook to generate the excitation waveform if the acoustic signal is not a band-limited signal, wherein the sparse codebook comprises a set of predetermined possible positions and the sub-sampled sparse code book comprises a subset of the predetermined positions, such that the excitation waveform is generated through placement of pulses within the predetermined positions or the subset;

wherein using the sub-sampled sparse codebook to generate the excitation waveform comprises generating an initial excitation waveform, determining whether the initial excitation waveform comprises mostly odd track positions or mostly even track positions, and decimating the initial excitation waveform.

* * * * *

UNITED STATES PATENT AND TRADEMARK OFFICE

CERTIFICATE OF CORRECTION

PATENT NO. : 7,698,132 B2
APPLICATION NO. : 10/322245
DATED : April 13, 2010
INVENTOR(S) : Kandhadai et al.

It is certified that error appears in the above-identified patent and that said Letters Patent is hereby corrected as shown below:

Column 15, line 44, Claim 5: “the periodicity” to read as --a periodicity--

Column 15, line 50, Claim 6: “the spectral content” to read as --a spectral content--

Column 15, line 57, Claim 17: “die” to read as --the--

Column 15, line 61, Claim 17: “die” to read as --the--

Column 20, line 11, Claim 34: “the quantization scheme” to read as --a quantization scheme--

Column 20, line 16, Claim 35: “the quantization scheme” to read as --a quantization scheme--

Signed and Sealed this
Twelfth Day of July, 2011

David J. Kappos

David J. Kappos
*Director of the United States Patent and Trademark Office*